United States Patent [19]

Schuring

[11] 4,031,678

[45] June 28, 1977

[54] INTERLOCKING BUILDING BLOCK CONSTRUCTION

[76] Inventor: James A. Schuring, 352 Saratoga Ave., Canton, Ohio 44708

[22] Filed: Nov. 20, 1975

[21] Appl. No.: 633,574

[52] U.S. Cl. ..... 52/285; 52/570; 52/589; 52/593; 52/314

[51] Int. Cl.[2] ..... E04B 1/02; E04C 1/08

[58] Field of Search ..... 92/570, 284–285, 92/563, 589–593, 314, 585, 595; 46/25

[56] References Cited

UNITED STATES PATENTS

| | | | |
|---|---|---|---|
| 1,789,099 | 1/1931 | Fusco et al. | 52/314 |
| 1,914,294 | 6/1933 | Richards | 52/590 |
| 1,981,324 | 11/1934 | Peterson | 52/590 |
| 3,382,632 | 5/1968 | Grofcsik | 52/585 |
| 3,676,969 | 7/1972 | Moore | 46/25 |

FOREIGN PATENTS OR APPLICATIONS

| | | | |
|---|---|---|---|
| 476,664 | 1915 | France | 52/590 |
| 517,750 | 3/1955 | Italy | 52/591 |

*Primary Examiner*—Price C. Faw, Jr.
*Assistant Examiner*—James L. Ridgill, Jr.
*Attorney, Agent, or Firm*—Frease & Bishop

[57] ABSTRACT

An interlocking building block construction comprising an overlapping masonry block having opposite sides, stepped opposite upper and lower longitudinal faces, and stepped opposite vertical end faces. A plurality of spaced tapered recesses with flat bottom surfaces are located on the upper longitudinal face, and a plurality of correspondingly shaped lugs are formed in the lower longitudinal face. There are two enlarged rectangular openings extending entirely through the block located in the central area of the upper and lower faces between the vertical end faces. A plurality of small apertures are formed in and adjacent to the lugs for receiving pins for interlocking adjacent blocks. Header blocks, pilaster blocks, partition blocks and filler blocks are provided for interlocking assembly with the interlocking building blocks to build walls of a building without the use of grout or cement. These special component blocks are formed with tapered recesses and lugs corresponding to the recesses and lugs of the interlocking building block for interlocking assembly therewith.

3 Claims, 14 Drawing Figures

INTERLOCKING BUILDING BLOCK CONSTRUCTION

BACKGROUND OF THE INVENTION

1. Field of the Invention

The invention relates to interlocking building block constructions of concrete or the like for the construction of walls, buildings, panels and similar masonry structures, and particularly, to a building block construction of the type which is layed up in the manner of a dry wall without mortar or concrete. More particularly, the invention relates to a building block construction having extended end portions which overlap and interlock with the extended end portions of adjacent blocks to form a self-supporting structure.

Description of the Prior Art

There are numerous types and styles of building blocks which have been devised to assist an inexperienced workman to building a necessary building or wall, which blocks may or may not require the use of a mortar or concrete filler. The following patents are believed to illustrate those block constructions having some features similar to my block construction: U.S. Pat. Nos. 708,499, 811,534, 979,913, 1,365,162, 1,667,160, 2,100,451, 2,311,628, 2,655,032, 2,688,245, 2,696,102, 3,063,202, 3,116,570, 3,422,588, and 3,534,518.

None of these constructions disclose a building block having upper and lower stepped end portions in combination with matching recesses and lugs, whereby the stepped end portions of the blocks, when assembled in a wall construction, overlap block portions of the adjacent blocks, with the lugs being engaged in corresponding recesses of the adjacent blocks, to form a rigid wall or building without the use of mortar.

SUMMARY OF THE INVENTION

Objectives of the invention include providing an interlocking building block construction for use in constructing walls and buildings without the use or mortar, grouting or cement, providing such a block construction which can be formed in various sizes depending upon local building codes and ordinances to provide the required structural strength for the particular building or wall being constructed, providing such a block construction which would be used with building plans designed specifically for use with the particular block showing the laying of each course, and showing the use of header, pilaster, and foundation blocks, and in which the plans would provide the exact number of the different types of blocks to be used and in what order, whereby a layman could construct the building or wall in reduced time and cost than that required by an experienced trademen; providing such a block construction which can be modified for use as the foundation blocks and pilaster blocks, especially when used in construction of a basement and in certain above ground commercial buildings, which modified block constructions have the important interlocking overlapping features incorporated therein; providing such a block construction having enlarged openings extending vertically through theblock, which openings align with similar openings in the blocks above and below, whereby a plurality of continuous vertically extending openings are formed in a wall for the installation of plumbing, electrical wiring, heating ducts, and the like; providing such an interlocking building block construction formed with a plurality of recesses and lugs which are complementary with the recesses and lugs, respectively, of adjacent blocks to provide the interlocking effect for the blocks, and in which holes are formed through certain of the endmost lugs and recesses for receiving locking pins therein to provide an additional mechanical interlock between adjacent blocks; providing such a block construction in which the extended ends of adjacent blocks can be joined longitudinally as in a wall structure and at right angles with respect to each other at the corners of a pair of connected walls without modification of the block with the interlocking feature still being provided; and providing an improved interlocking building construction which eliminates difficulties heretofore encountered, achieves the stated objectives simply and effectively, and which solves problems and satisfies existing needs.

These objectives and advantages are obtained by the improved interlocking building block construction, the general nature of which may be stated as including a longitudinally extending generally rectangular upper surface terminating at one end in a lower stepped end surface, and a longitudinally extending generally rectangular lower surface terminating at one end in an upper stepped end surface, the stepped end surfaces lying in a common horizontal plane and located at opposite ends of the building block; the longitudinal lengths of the stepped end surfaces being equal to each other and equal to the width of the upper and lower surfaces, with the longitudinal lengths of the upper and lower surfaces each being twice the longitudinal length of each of the stepped end surfaces; a pair of opposite vertically extending sides; the upper surface terminating in first and second vertical end faces, the first vertical end face extending between the upper surface and the lower stepped end surface and the second vertical end face extending between the upper surface and the upper stepped end surface, the first and second vertical end faces being parallel to each other and extending transversely between the pair of opposite sides; the lower surface terminating in third and fourth vertical end faces, the third vertical end face extending between the lower surface and the lower stepped end surface and the fourth end face extending between the lower surface and the upper stepped end surface, the third and fourth vertical end faces being parallel to each other and extending transversely between the pair of opposite sides; recess means formed in the upper surface and lower stepped end surface; lug means formed on the lower surface and upper stepped end surface, the lug means being aligned vertically with the recess means; the upper stepped end surface of each of the blocks being adapted to be located in abutting overlapping relationship with the lower stepped end surface of a longitudinally adjacent block with the vertically extending sides of said blocks forming a vertical wall surface, with the first and third vertical end faces of each block being adapted to be in abutting relationship with the second and fourth vertical end faces, respectively, of an adjacent block, with the upper surfaces of adjacent blocks and the lower surfaces of the adjacent blocks being adapted to lie in spaced horizontal planes; the lug means of the upper stepped end surface of the block being adapted to be received in recess means of the lower stepped end surface of an adjacent block to provide the interlocking relationship therebetween when forming a wall with a plurality of the blocks; the recess means includes a plurality of longitudinally spaced recesses formed in the upper surface and a single recess formed in the lower stpped end surface; the lug means includes a plurality of lugs formed on the lower surface and a single lug formed on the upper stepped end surface, with each of the lugs being vertically aligned with a respective one of the recesses; certain of the aligned lugs and recesses being formed with holes for receiving pin means for mechanically interconnected adjacent blocks in a wall structure; and opening means being formed in the block extending vertically through the block and communicating with the upper and lower surfaces.

BRIEF DESCRIPTION OF THE DRAWINGS

Preferred embodiments of the invention - illustrative of the best modes in which applicant has contemplated applying the principles - are set forth in the following description and shown in the drawings and are particularly and distinctly pointed out and set forth in the appended claims.

Similar numerals refer to similar parts throughout the drawings.

DESCRIPTION OF THE PREFERRED EMBODIMENTS

First Embodiment

Figure 1:
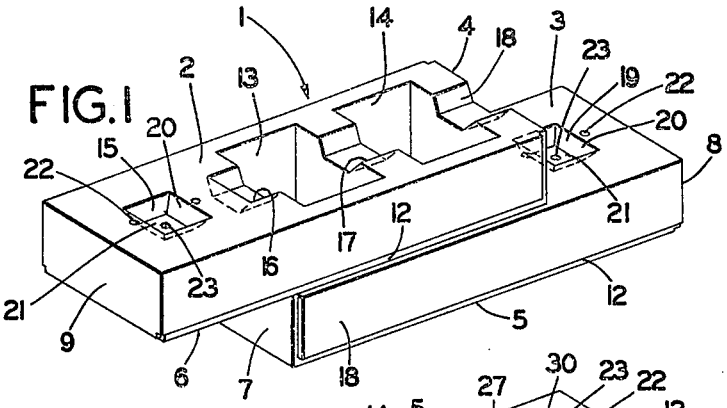
FIG. 1 is a perspective view showing the upper side of the main interlocking building block construction.
Figure 2:
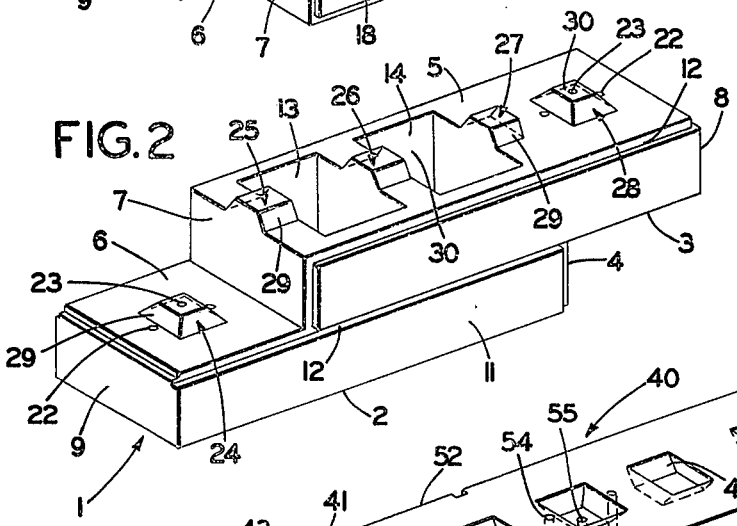
FIG. 2 is a perspective view showing the lower side of the main interlocking building block of FIG. 1.

The main embodiment of the invention is shown in FIGS. 1 and 2, and is indicated generally at 1. Block construction 1 has an elongated, rectangular-shaped, flat upper surface 2 which terminates in a lower stepped end surface 3. Stepped end surface 3 is square, having a width equal to the width of surface 2, with the length of surface 2 preferably being three times that of surface 3. Surfaces 2 and 3 are connected by a vertically extending end face 4.

A longitudinally extending lower surface 5 terminates in an upper stepped end surface 6 (FIG. 1) at an end of block 1 opposite to stepped surface 3. A vertically extending end face 7 extends between and connects surface 5 and 6, with end face 7 being parallel with opposite end face 4. Stepped end surfaces 3 and 6 lie in a common horizontal plane.

Stepped end surface 3 is connected to lower surface 5 by a vertical end face 8, with stepped end surface 6 being connected to upper surface 2 by another vertical end face 9. A pair of opposite sides 10 and 11 extend longitudinally with respect to upper and lower surfaces 2 and 5, and transversely with respect to end face 4, 7, 8 and 9. Sides 10 and 11 have a generally Z-shaped configuration, as shown in FIG. 1. Peripheral grooves 12 are formed in portions of sides 10 and 11 which provide imitation mortar joints simulating individual bricks when assembled in a completed wall or building.

A pair of openings 13 and 14 are formed in the central portion of block 1 and extend completely through the block between surfaces 2 and 5. Openings 13 and 14 form a pair of continuous, vertically extending passages within a wall constructed from a plurality of blocks 1 for receiving plumbing, electrical wiring, heating and cooling ducts, etc.

A plurality of recesses 15, 16, 17 and 18 are formed in upper surface 2, with a single recess 19 being formed in stepped end surface 3. Recesses 15-19 preferably have two or more downwardly, inwardly tapered walls 20 which terminate in a flat bottom surface 21. A plurality of small holes 22 are formed in block 1 adjacent recesses 15 and 19, with similar holes 23 being formed in the bottom surface 21 of recess 15 and 19, the purpose of which is discussed below.

A plurality of lugs 25, 26, 27 and 28 are formed on lower surface 5 and project outwardly therefrom, with a single lug 24 being formed on stepped surface 6. Lugs 24–28 align vertically with corresponding recesses 15–19 of upper surface 2, and stepped surface 3 with holes 23 extending through lugs 15 and 19. Lugs 24–28 have a truncated pyramid configuration with two or more upwardly, inwardly tapered walls 29 terminating in a flat end surface 30. Lugs 24–28 are complementary in size and configuration with corresponding recesses 15–19 to provide the interlocking relationship with the adjacent blocks of a wall or building.

A preferred size of building block 1 is 4 × 4 × 16 inches with the total length of top surface 2 and 3 being 16 inches, as well as the total length of surfaces 5 and 6.

A filler block, indicated generally at 31 (FIGS. 3 and 4), may be required in some installations at the location of doorways, corners, partitions, or the like for use with block construction 1. Filler block 31 has a square cross-sectional configuration having top surface 32, an opposite lower surface 33, a pair of opposed vertical end faces 34 and 35, and an opposite pair of sides 36 and 37. A recess 38 similar to recesses 15 and 19, is formed in top surface 32 with a corresponding lug 39 projecting outwardly from lower surface 33. Lug 39 is similar in size and configuration to lugs 24 and 28 of block 1. Filler block 31 is adapted to be placed in abutting relationship with stepped end surfaces 3 and 6 to provide a smooth continuous top surface, and end and side surfaces for block 1 where necessary. Therefore, surface 32 of filler block 31 is identical in size and configuration to stepped end surfaces 3 and 6 with the thickness or length of end faces 34 and 35 being equal to the length of end faces 4, 7, 8 and 9.

Second Embodiment

Figure 5:
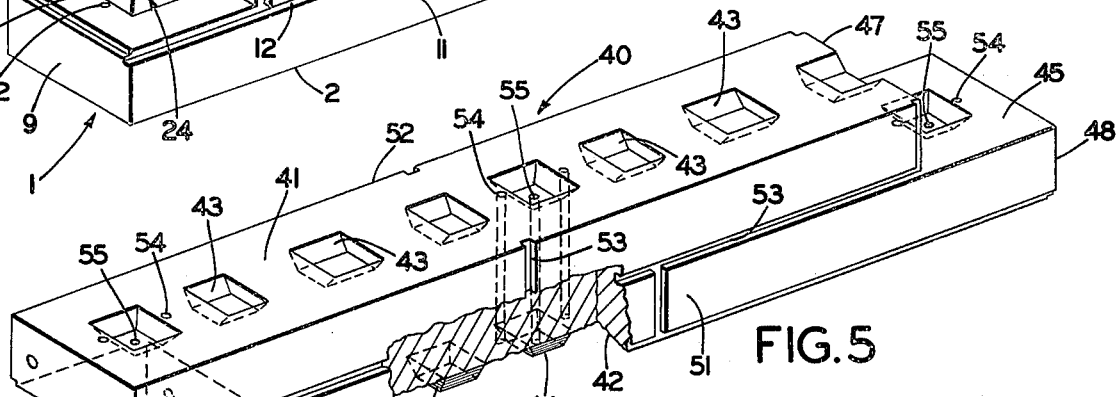
FIG. 5 is a perspective view, with portions broken away and in section, showing the upper side of a header block to be used with the block of FIGS. 1 and 2.

A modified form of the improved building block construction is indicated generally at 40, and is shown in FIG. 5. Block 40 preferably is used as a header block above doorways and the like. Block 40 includes an upper rectangular surface 41 and a similar bottom surface 42. A plurality of recesses 43 (eight of which are shown in FIG. 5) are formed in upper surface 41 and are spaced longitudinally therealong. A plurality of lugs 44 are formed on bottom surface 42 and project outwardly therefrom, only two of which are shown in FIG. 5. Lugs 44 are complementary with recesses 43 as in the construction of block 1, and are aligned vertically therewith.

Figure 3:
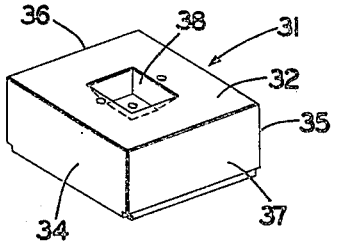
FIG. 3 is a perspective view showing the upper side of a filler block for use with the building block of FIGS. 1 and 2.
Figure 4:
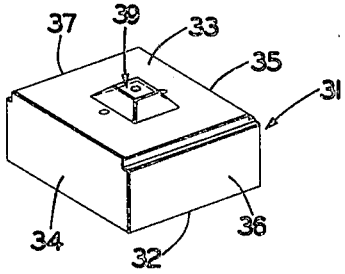
FIG. 4 is a perspective view of the lower side of the filler block of FIG. 3.

Upper surface 41 terminates in a lower stepped end surface 45, with bottom surface 42 terminating in an upper stepped end surface 46. Stepped end surfaces 45 and 46 are similar in shape and size to stepped end surfaces 3 and 6, respectively, of block construction 1, and therefore, may be assembled readily with adjacent block constructions 1. Stepped end surfaces 45 and 46 also lie in a common horizontal plane as do surfaces 3 and 6 of block 1. Likewise, filler block 31 of FIGS. 3 and 4 is complimentary in shape and size to the stepped end areas formed at the ends of header block 40.

Header block 40 includes vertical end faces 47, 48, 49 and 50, which are similar in shape and size to vertical end faces 4, 8, 9 and 7, respectively, of block 1. Block 40 also includes sides 51 and 52 which extend transversely with respect to end faces 47-50, and which are formed with imitation mortar grooves 53 along certain edges and longitudinally across the middle of outer side 51. Holes 54 and 55, similar to holes 22 and 23 of block 1, are formed in block 40 adjacent to and within the endmost and center recesses 43, and extend vertically through block 40 for receiving reinforcing pins.

Header block 40 may have various longitudinal lengths depending upon the particular door size or installation in which it will be installed, and will have a height and depth equal to that of block 1. A preferred size of header block 1 is 4 × 4 × 28 inches with the total length of upper surface 41 and stepped end surface 45 being 28 inches, which is equal to the total length of surfaces 42 and 46.

Third Embodiment

Figure 6:
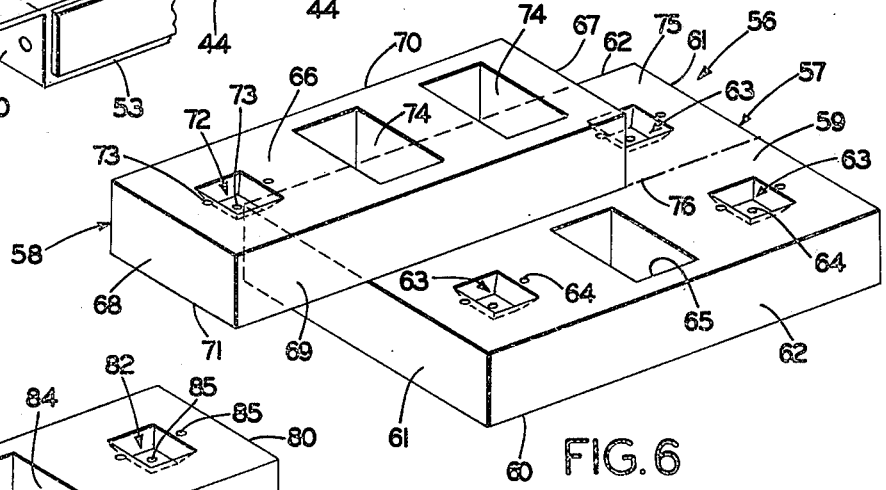
FIG. 6 is a perspective view of the upper side of a pilaster block to be used with the main building block of FIGS. 1 and 2.

Another type of building block adapted for use with main building block 1 is a pilaster block indicated generally at 56 (FIG. 6). Pilaster block 56 has a rectangular base 57 with a smaller rectangular block portion 58 formed integrally with base 57 and overlapping an end thereof. Base 57 has flat top and bottom surfaces 59 and 60, a pair of spaced end faces 61, and a pair of spaced side surfaces 62. A plurality of recesses 63, having the spacing and configuration shown in FIG. 6 are formed in top surface 59 of base 57, with corresponding lugs (not shown) projecting outwardly from bottom surface 60 vertically aligned with recesses 63. The lugs of block 56 are similar to lugs 24 and 28 of block 1 and, therefore, are not shown in detail. Reinforcing pin receiving holes 64 are formed through base 57 adjacent to and within recesses 63. An enlarged opening 65, similar to openings 13 and 14 of block 1, is formed in and extends through base 57 for receiving electrical wiring, plumbing, etc.

Block portion 58 has an upper rectangular surface 66, a pair of spaced end faces 67 and 68, a pair of spaced side surfaces 69 and 70, and an overhanging, stepped end-like surface 71. A single recess 72, similar to recess 63 is formed in upper surface 66 adjacent the overhanging end thereof, with pin receiving holes 73 being formed within and adjacent to recess 72. A pair of spaced openings 74 also are formed in block portion 58, similar to openings 13, 14 and 65 for receiving electrical conduits, plumbing, etc.

Block portion 58 is similar in external shape and size to the upper half block portion of main block construction 1, with end faces 68, side surfaces 69 and upper surface 66 being similar in shape and size to the corresponding portions of block 1. Rectangular base 57 has a depth defined by the length of end faces 61, preferably twice the depth of block portion 58, and correspondingly, twice the depth of block 1.

Overhanging surface 71 of block portions 58 is complementary in shape and size to that of lower stepped end surface 3 of block 1, with the squared area 75 defined by the rear right-hand corner of base 57 and dot-dash line 76 being complementary in shape and size to that of upper stepped end surface 6 of block 1. Therefore, in assembling pilaster blocks 56 with adjacent building blocks 1, lug 24 of stepped end surface 6 will project into and be engaged with recess 63 of squared area 75 and with the downwardly projecting lug (not shown) formed on overhanging surface 71 projecting into complementary recess 19 of the lower stepped end surface 3 of block 1 to provide the interlocking relationship between blocks 1 and pilaster block 56.

Figure 7:
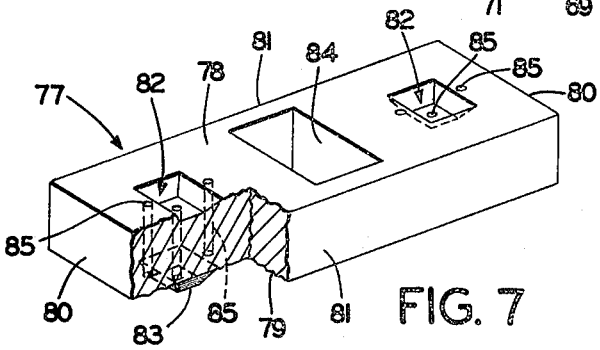
FIG. 7 is a perspective view with portions broken away and in section, showing the upper side of a pilaster filler block to be used with the pilaster block of FIG. 6.

A pilaster filler block of the type shown in FIG. 7 and indicated generally at 77, will be used in conjunction with main pilaster block 56. Filler block 77 has a rectangular shape with flat top and bottom surfaces 78 and 79, respectively, spaced end faces 80 and spaced side surfaces 81. A pair of recesses 82 are formed in top surface 78 with corresponding lugs 83 projecting outwardly from bottom surface 79 in vertical alignment with recesses 82. A central opening 84 is formed in and extends through filler block 77. Recesses 82, lugs 83 and openings 84 are similar to the above described recesses, lugs and openings for blocks 1, 31, 40 and 56, and therefore, are not described in further detail.

Filler block 77 has a vertical height defined by spaced end faces 80 and side surfaces 81 which is equal to the height of rectangular block portion 58 of pilaster block 56. Filler block 77 has a length equal to that of pilaster base 57 as has a depth defined by the transverse length of spaced end faces 80, which depth is equal to the depth of the elongated rectangular front half-portion of base 57.

A pilaster filler block 77 is placed on top of each front half-portion of main pilaster block 56 with lugs 83 being engaged in the front two recesses 63 of the adjacent lower block 56, with the lugs which correspond to these recesses 63 of pilaster block 56 being engaged in recesses 82 of the lower pilaster filler block. Openings 84 align with openings 65 to form a continuous vertically extending passage through the front portion of the stack of pilaster and filler blocks 56 and 77. Holes 85 are formed in and adjacent to recesses 82 of filler block 77 for receiving reinforcing pins which extend into vertically aligned holes 64 of pilaster base 57 to provide a mechanical interlock between the stacked pilaster blocks 56 and filler blocks 77. End faces 61 and 80 of main pilaster block base 57 and filler block 77, respectively, align vertically and lie in a pair of spaced vertical planes, as do front side surfaces 62 and 81.

Fourth Embodiment

Figure 8:
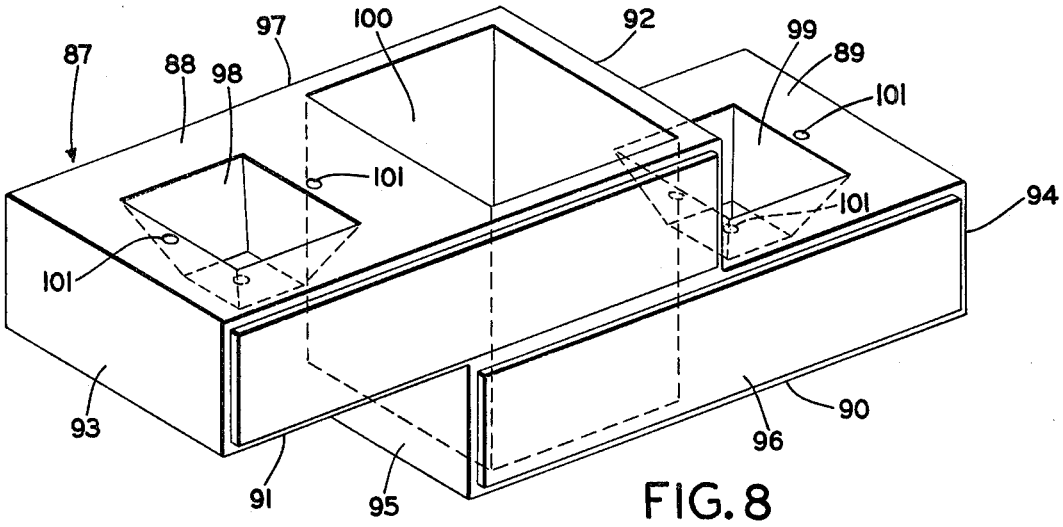
FIG. 8 is a slightly enlarged perspective view showing the upper side of a foundation block to be used with the main building block of FIGS. 1 and 2.

A further modified form of the improved interlocking building block construction is indicated generally at 87, and is shown in FIG. 8, and is intended primarily for use as a foundation block used in construction of a building having a basement or the like. Foundation block 87 is similar to main block construction 1 in that it has a flat upper surface 88 terminating in a lower stepped end surface 89, with a lower surface 90 terminating in an upper stepped end surface 91, and with stepped end surface 89 and 91 lying in a common horizontal plane.

Foundation block 87 further includes spaced vertical faces 92, 93, 94 and 95 which are similar to end faces 4, 9, 8 and 7, respectively, of block construction 1. Likewise, block 87 includes vertically extending side surfaces 96 and 97 similar to side surfaces 10 and 11 of block 1.

Recesses 98 and 99 are formed in top surface 88 and stepped end surface 89, respectively, and are provided with complementary shaped lugs (not shown) projecting outwardly, downwardly from stepped end surface 91 and bottom surface 90, vertically aligned with recesses 98 and 99, respectively. An enlarged central opening 100 is formed in the central portion of block 87 and extends vertically therethrough. Reinforcing pin receiving holes 101 are formed in and adjacent to recesses 98 and 99 as shown.

Foundation blocks 87 are placed in interlocking relationship as is main construction block 1 with a lower stepped end surface 89 of one block being in abutting relationship with an upper stepped end surface 91 of a second adjacent block, with the respective lug being engaged with recess 99 to form the interlocking engagement between the adjacent blocks. Foundation blocks 87 preferably have a depth approximately twice the depth of blocks 1, 31, 40 and 77, and with the longitudinal length of stepped ends 89 and 91 being equal to each other. Also, the longitudinal length of upper surface 88 and bottom surface 90 is twice the length of stepped end surfaces 89 and 91, individually.

Fifth Embodiment

Figure 9:
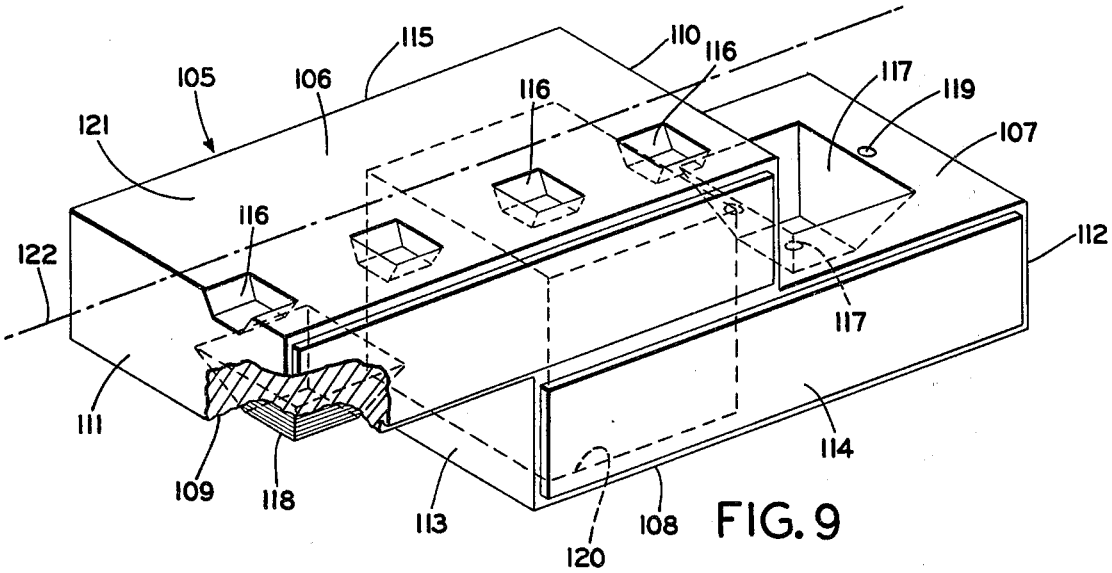
FIG. 9 is a slightly enlarged perspective view showing the upper side of a top course foundation block to be used with the main building block of FIGS. 1 and 2, and with the foundation block of FIG. 8.

A still further modified form of the improved interlocking building block construction is indicated generally at 105, and is shown in FIG. 9, and is a top course foundation block. Top course block 105 also is similar in construction to main block 1, header block 40 and foundation block 87 in that it has an upper rectangular surface 106 terminating in a lower stepped end surface 107, and a rectangular bottom surface 108 terminating in an upper stepped end surface 109. Block 105 further includes parallel spaced vertical end faces 110, 111, 112, and 113, together with vertically extending spaced side surfaces 114 and 115.

A plurality of recesses 116 are formed in upper surface 106 and are complementary in size and spacing to lugs 25, 26, 27 and 28 of bottom surface 5 of main block construction 1. An enlarged recess 117 is formed in stepped end surface 107 and is complementary in size and shape to an enlarged lug 118, formed on and projecting downwardly from upper stepped end surface 109. Lugs 18 of blocks 105 are adapted to be engaged in recesses 117 of longitudinally adjacent blocks 105 in forming the top course, with lower stepped end surfaces 107 abutting upper stepped end surfaces 109 in a similar manner as when block constructions 1, 40, 56 and 87 are assembled in a wall construction.

A second lug (not shown) which is similar to lug 118 is formed on and projects downwardly from flat bottom surface 108 vertically beneath recess 117 for interlocking engagement in complementary recess 98 of the topmost course of foundation block 87. Pin receiving holes 119 also are formed in lower stepped end surface 107 adjacent enlarged recess 117, as well as within recess 117, similar to the pin receiving holes described above for the other block contructions. An enlarged central chamber 120 is formed in the interior of the central portion of block 105. Chamber 120 aligns with central opening 100 of foundation block 87 when assembled therewith, so that the vertical passages formed by openings 100 extends throughout the building foundation completely to the top of the foundation wall including top course blocks 105.

The depth of upper surface 106 of block 105, defined by the transverse length of end faces 110 and 111, preferably is twice the depth of main block construction 1. Thus, a ledge-like formation 121, (defined by dot-dash line 122 which would be the extremity of block 1) is formed on block 105 for receiving and supporting the ends of the floor joists. Likewise, the length, depth, and width of block 1 is similar to foundation block 87.

Sixth Embodiment

Figure 10:
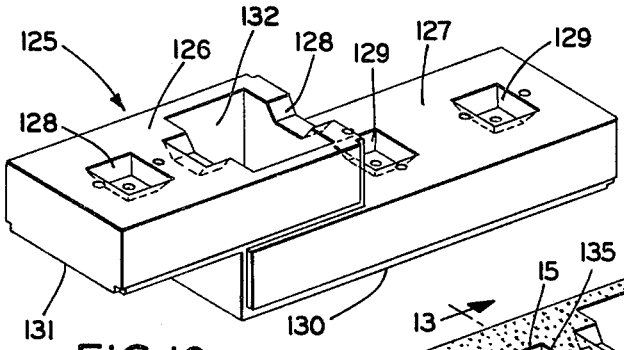
FIG. 10 is a slightly reduced perspective view showing the upper side of a partition block to be used with the main building blocks of FIG. 1 and 2.

A partition block, indicated generally at 125, is shown in FIG. 10, and is similar in most respects to main building block 1 except that the upper top surface 126 is equal in size to lower stepped end surface 127. Upper surface 126 is provided with three recesses 128, with lower stepped end surface 127 being provided with two recesses 129. Lugs (not shown) are formed on the bottom surface 130 and on the upper stepped end surface 131, which lugs are vertically aligned with a respective one of the recesses 128–129. The recesses and lugs of partition block 125 are similar in shape, size and configuration to those of block 1, so as to be compatible therewith. A central, enlarged opening 132 is formed in top surface 126 and extends throughout the block, communicating with bottom surface 130 in a similar manner as openings 13 and 14 of block 1, and the corresponding openings in the other block constructions.

IN GENERAL

Figure 11:
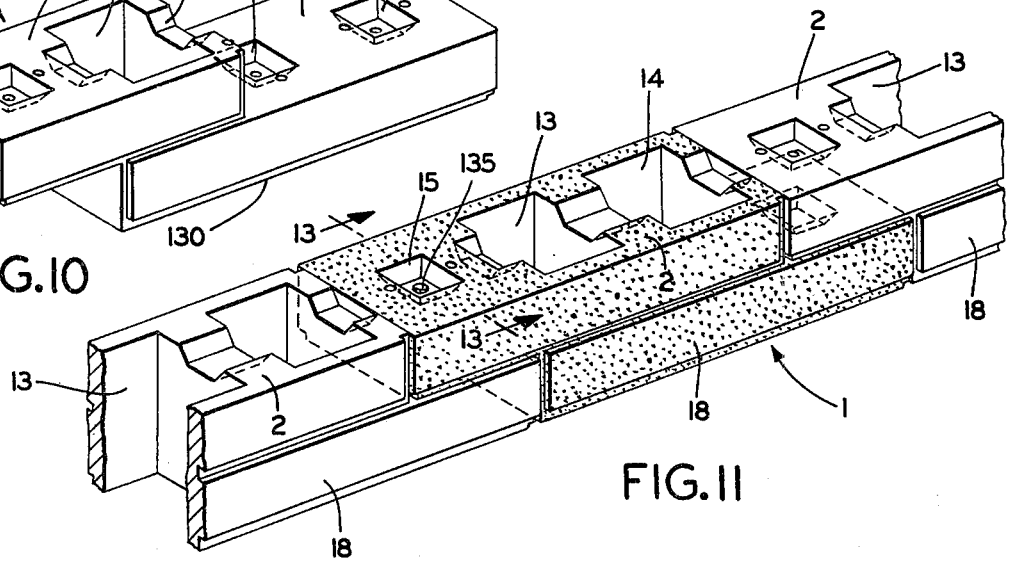
FIG. 11 is a fragmentary perspective view showing the main building block of FIGS. 1 and 2 being arranged in interlocking relationship with two horizontally adjacent blocks.
Figures 12, 13, 14:
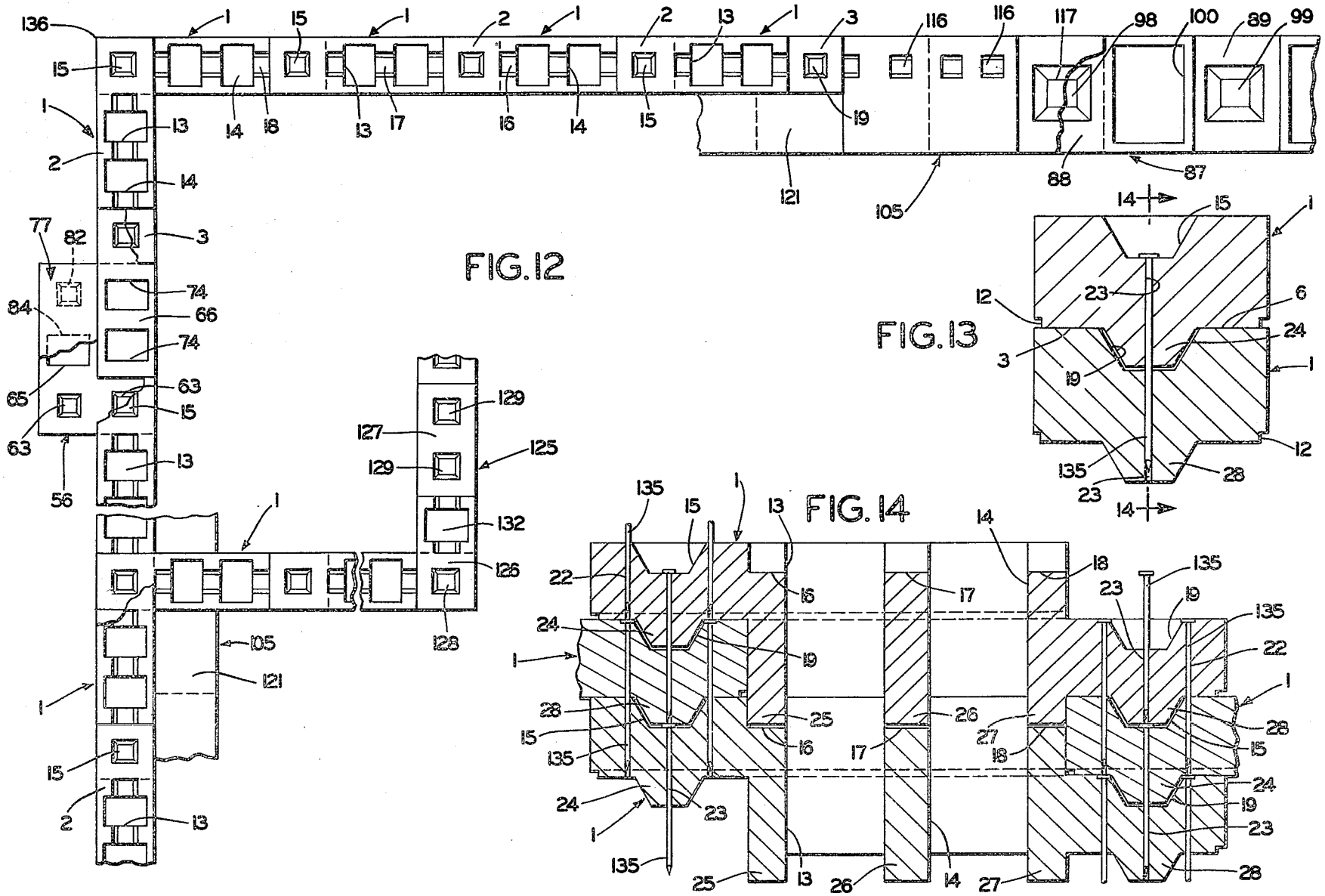
FIG. 12 is a diagrammatic view of a corner of a wall and partition thereof, illustrating the uses of the blocks of FIGS. 1–10.
FIG. 13 is an enlarged transverse sectional view of a pair of assembled main interlocking building blocks taken on line 13—13, of FIG. 11.
FIG. 14 is a further enlarged longitudinal sectional view of the assembled building blocks, taken on line 14—14, FIG. 13.

The interlocking relationship between the various block constructions is shown diagrammatically in FIG. 12, and particularly with respect to main building block construction 1 in FIGS. 11, 13 and 14. FIG. 13 is a transverse sectional view through a pair of interlocked blocks 1, and in particular through an endmost recess 15, lower stepped end recess 19, and a vertically aligned lug 24, formed on an upper surface 6, lower stepped end surface 3, and on an upper stepped end surface 6, respectively. Surfaces 6 lie in overlapping, abutting relationship with lower stepped end surfaces 3 of the horizontally adjacent blocks 1 as shown in FIG. 11. Likewise, end faces 4 and 8, and 9 and 7 of one block 1 abut end faces 9 and 7, and 4 and 8, respectively, of the two horizontally adjacent blocks. Reinforcing pins 135 extend through holes 22 and 23 of the adjacent blocks 1 to provide a mechanical interlock therebetween, in addition to the engagement of lugs 24 with recesses 15 (FIGS. 13 and 14).

FIG. 14 is a longitudinal sectional view showing the vertical assembly of two complete block contructions 1 interlockingly engaged with the end portions of two adjacent block constructions 1. FIG. 14 shows the formation of a pair of vertically extending passages throughout the multiple courses of blocks, provided by aligned individual openings 13 and 14 of blocks 1 through which the wiring ducts, heating, telephone wires, etc. may be placed for distribution throughout the building. The use and arrangement of reinforcing pins 135 also is shown in FIG. 14, whereby the wall formed by the blocks has an extremely strong mechanical tie between both the vertical and horizontal adjacent blocks.

FIG. 12 shows diagrammatically, portions of walls formed by the various block constructions described in detail above. The upper right-hand end of the wall of FIG. 12 illustrates the upper surface 88 of a foundation block 87 showing the particular arrangement of recesses 99 and a portion of recess 98, together with enlarged central opening 100. A top course foundation block 105 (the right-hand end of which is broken away) is shown engaged with foundation block 87 showing the location of endmost recess 117 and and the spacing and location of smaller recesses 116. A main building block construction 1 then is shown mounted on a top course block 105 with several other horizontally adjacent block contructions 1 being interlockingly engaged therewith extending toward the corner of the wall. The arrangement of block 1 with top course foundation block 105 shows the formation of ledge 121 for receiving the floor joists thereon. The foundation and top course blocks are not shown throughout the remainder of the wall construction of FIG. 12, other than in the right-hand portion thereof for clarity reasons.

The right-angle corner 136 is formed by the overlapping, interlocking engagement of the stepped end surfaces of the blocks at right angles with respect to each other instead of the heretofore straight line 180° engagement relationship as shown for the main straight wall portion.

Blocks 1 are broken away to show a pilaster block 56 in combination with a portion of a pilaster filler block 77 in the center of the left hand wall portion of FIG. 12. The lower left-hand portion of the wall of FIG. 12 shows the use of a partition block 125 in combination with main building block constructions 1.

The interlocking details of the various block constructions are similar to the arrangements shown in FIGS. 11, 13 and 14 wherein the stepped end surfaces lie in overlapping relationships with the adjacent blocks with the corresponding lugs and recesses being in locking engagement together with interlocking reinforcing pins 135. Thus, this interlocking relationship is not shown or described in detail for these remaining block arrangements of the wall of FIG. 12. A header block 40 also can be installed at various locations within the wall depending upon the location of doorways, windows and the like. Header block 40 is assembled with the adjacent blocks 1 in a similar manner as shown in FIG. 11.

Thus, the walls formed by the various block constructions described above eliminate the use of grouting or mortar heretofore required with prior wall constructions without loss of structural strength due to the mechanical interlocking by pins 135 and the corresponding blocking recesses and lugs. The exterior of the formed wall will have a simulated, individual block design due to grooves 12 and 53 formed therein, with the interior of the wall having either a smooth surface or similar imitation brick as is the outside wall depending upon the absence or inclusion of grooves 12 and 53. Likewise, the blocks shown may be of various sizes without departing from the concept of the invention to conform to local building codes or for the particular type of building being constructed. However, the various block sizes preferably maintain the proportional relationship described above, whereas the stepped end surfaces are square so that the adjacent blocks can be interlockingly engaged therewith in either a straight line fashion or at a 90° angle to form a building corner.

Accordingly, the improved interlocking building block constructions are simplified, and provide effective, safe, inexpensive and efficient building blocks which achieve the enumerated objectives, provide for eliminating difficulties encountered with prior block constructions, solve problems and obtain new results in the art; and provide for the formation of walls and buildings without the use of mortar or cement.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the interlocking building block construction is constructed, and the advantageous, new and useful results obtained; the new and useful structures, devices, elements, arrangements, parts and combinations, are set forth in the appended claims.

I claim:

1. A rectangular building structure formed entirely of a plurality of similar interlocking building blocks, each block including:

a. a longitudinally extending, rectangular, upper surface terminating at one end in a lower stepped end surface;

b. a longitudinally extending, rectangular, lower surface terminating at one end in an upper stepped end surface;

c. said stepped end surfaces lying in a common horizontal plane and located at opposite ends of the building block;

d. a plurality of generally truncated pyramid-shaped recess means formed in the upper rectangular surface and a corresponding number of complementary generally turncated pyramid-shaped lug means formed on the lower rectangular surface, said lug means being aligned vertically with the recess means;

e. a single recess formed in the center of the lower stepped end surface and a single lug formed on the center of the upper stepped end surface, said lug and recess each having a truncated pyramid configuration complementary to each other;

f. the stepped end surfaces having a square planar configuration with the longitudinal lengths of the stepped end surfaces being equal to each other, and equal to the width of the upper and lower surfaces;

g. a first pair of spaced, parallel, vertically extending smooth end surfaces connecting the stepped end surfaces to their respective longitudinally extending rectangular surfaces;

h. a second pair of spaced, parallel, vertically extending smooth end faces connecting the upper surface with the upper stepped end surface and connecting the lower surface with the lower stepped end surfaces, respectively;

i. a pair of spaced, parallel, vertical, generally smooth side surfaces extending between the upper and lower rectangular surfaces, and between the pairs of spaced end surfaces;

j. the upper stepped end surfaces of the blocks being in abutting, overlapping relationship with lower stepped end surfaces of horizontally adjacent blocks with the single lugs of the upper stepped end surfaces being interlockingly engaged in the single recesses of the overlapped lower stepped end surfaces, with the lower rectangular surfaces being in abutting relationship with the upper rectangular surfaces of lower vertically adjacent blocks with the lug means of the lower surfaces being interlockingly engaged in the complementary recesses of the upper surfaces; and with the side surfaces of said horizontally and vertically adjacent blocks forming smooth continuous longitudinally extending wall surfaces, and with the side surfaces of adjacent blocks placed at right angles to each other forming smooth continuous right-angled corner surfaces;

k. opening means formed in and extending vertically through each block and communicating with the upper and lower rectangular surfaces, with said opening means of vertically adjacent blocks forming vertically extending passages in the building walls for receiving utility supply lines;

l. holes formed in the stepped end surfaces single lugs and recesses and vertically aligned with each other; and m. pin means mounted in the aligned recess and lug holes and extending between a pair of vertically adjacent blocks mechanically interconnecting said adjacent blocks.

2. The construction defined in claim 1 in which peripheral groove means is formed in at least one of the pair of opposite vertical side surface to provide imitation mortar joints between adjacent building blocks when in assembled position.

3. The construction defined in claim 1 in which the longitudinal lengths of the upper and lower surfaces are each three times the longitudinal length of each of the stepped end surfaces.

* * * * *

UNITED STATES PATENT AND TRADEMARK OFFICE

CERTIFICATE OF CORRECTION

PATENT NO. : 4,031,678

DATED : June 28, 1977

INVENTOR(S) : James A. Schuring

It is certified that error appears in the above-identified patent and that said Letters Patent are hereby corrected as shown below:

Column 3, line 3, change "stpped" to -stepped-;

Column 3, line 10, change "interconnected" to -interconnecting-

Column 6, line 33, change "portions" to -portion-;

Column 6, line 65, change "as" to -and-; and

Column 10, line 14, change "blocking" to -block-.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*